US010321243B2

(12) United States Patent
De Haan et al.

(10) Patent No.: US 10,321,243 B2
(45) Date of Patent: Jun. 11, 2019

(54) HEARING DEVICE COMPRISING A FILTERBANK AND AN ONSET DETECTOR

(71) Applicant: Oticon A/S, Smørum (DK)

(72) Inventors: Jan Mark De Haan, Smørum (DK); Fares El-Azm, Smørum (DK)

(73) Assignee: Oticon A/S, Smørum (DK)

( * ) Notice: Subject to any disclaimer, the term of this patent is extended or adjusted under 35 U.S.C. 154(b) by 64 days.

(21) Appl. No.: 15/608,447

(22) Filed: May 30, 2017

(65) Prior Publication Data

US 2017/0347207 A1 Nov. 30, 2017

(30) Foreign Application Priority Data

May 30, 2016 (EP) ..... 16172060

(51) Int. Cl.
*H04R 25/00* (2006.01)
*G10L 19/025* (2013.01)

(52) U.S. Cl.
CPC ..... *H04R 25/505* (2013.01); *H04R 25/353* (2013.01); *H04R 25/356* (2013.01);
(Continued)

(58) Field of Classification Search
CPC .... H04R 25/30; H04R 25/353; H04R 25/356; H04R 25/43; H04R 25/505; H04R 2225/43; H04R 2430/03; H04R 2225/41
(Continued)

(56) References Cited

U.S. PATENT DOCUMENTS 5,500,902 A * 3/1996 Stockham, Jr. ..... H03G 9/005 381/106
5,687,241 A * 11/1997 Ludvigsen ..... H03G 9/005 381/312
(Continued)

FOREIGN PATENT DOCUMENTS

EP 2335427 A1 6/2011
EP 2980800 A1 2/2016
WO WO 2010/028683 A1 3/2010

OTHER PUBLICATIONS

Anssi Klapuri, "Sound Onset Detection by Applying Psychoacoustic Knowledge", XP-010328057, vol. 6, Mar. 15, 1999, pp. 3089-3092.
(Continued)

*Primary Examiner* — Huyen D Le
(74) *Attorney, Agent, or Firm* — Birch, Stewart, Kolasch & Birch, LLP

(57) ABSTRACT

A hearing device comprises A) a forward path, comprising a1) an input unit for providing a time-domain electric input signal as digital samples, a2) an analysis filter bank configured to provide a time-frequency representation of said electric input signal, a3) a signal processing unit for processing a signal of the forward path and providing a number of processed channel-signals, B) an onset detector configured to receive said time-domain electric input signal before entering said analysis filter bank, and to provide an onset control signal dependent on a current first order derivative of an envelope thereof, C) a level estimation unit for estimating a current level of said frequency sub-band signals, and comprising c1) a level adjustment unit configured to adjust the current levels of said frequency sub-band signals, and to control said level adjustment in dependence of said onset control signal. The invention may be used in audio devices, e.g. hearing aids.

19 Claims, 9 Drawing Sheets

(52) U.S. Cl.
CPC ..... *H04R 25/43* (2013.01); *G10L 19/025* (2013.01); *H04R 2225/41* (2013.01); *H04R 2225/43* (2013.01); *H04R 2430/03* (2013.01)

(58) Field of Classification Search
USPC ..... 381/58, 312, 320, 321, 94.2, 94.3, 106
See application file for complete search history.

(56) References Cited

U.S. PATENT DOCUMENTS

| | | | | |
|---|---|---|---|---|
| 6,044,162 | A * | 3/2000 | Mead | H04R 25/356 381/312 |
| 8,929,574 | B2 | 1/2015 | Nielsen et al. | |
| 9,313,359 | B1 | 4/2016 | Stojancic et al. | |
| 2006/0018486 | A1 | 1/2006 | Neoran et al. | |
| 2011/0268301 | A1 | 11/2011 | Nielsen et al. | |
| 2013/0010982 | A1 | 1/2013 | Elko et al. | |
| 2015/0207479 | A1 | 7/2015 | Baumgarte | |

OTHER PUBLICATIONS

Rosão et al. "Trends in Onset Detection", Open Source and Design of Communication, Jul. 11, 2011, XP-058006459, pp. 75-81.

* cited by examiner

HEARING DEVICE COMPRISING A FILTERBANK AND AN ONSET DETECTOR

SUMMARY

Filter banks are used in hearing devices, such as hearing aids, in order to provide the possibility of signal processing in frequency bands. Individual processing in a number of distinct or overlapping frequency sub-bands is e.g. of interest in some signal processing algorithms. Different processing types may pose different requirements on the frequency channels in which the processing is performed.

Signal processing algorithms that operate in the time-frequency domain suffer from the fact that filtering into sub-bands as done with filter banks leads to temporal smearing of very-short-in-time input signals such as transients. Examples of such time-frequency processing is noise reduction, dynamic range compression and output power limiting in hearing aids. All these algorithms use level estimation in some form.

Level estimation based on filter bank sub-bands suffers from time delay in the analysis stage, even when the fastest possible time constants are used in the level estimator. This means that input-dependent gain may not be on time and the processed signal may be corrupted with overshoot artefacts. The problem increases with higher frequency resolution and higher number of sub-bands.

U.S. Pat. No. 8,929,574B2 deals with a hearing aid and a method of detecting and attenuating transients. The hearing aid has means for detecting fast transients in the input signal and means for attenuating the detected transients prior to presenting the signal with the attenuated transients to a user. Detection is performed by measuring the peak difference of the signal upstream of a band split filter bank and comparing the peak difference against at least one peak difference limit.

A Hearing Device:

The present disclosure proposes to adjust a level estimator, based on the input signal to the filter bank. The level estimator usually consists of a pre-smoother that reduces large variance at the input and a smoother that gives the correct time-constant behaviour of the final level estimate. This consists of two parts. Onset Detection and Level Adjustment.

In an aspect of the present application, there is provided a hearing device, e.g. a hearing aid, comprising

- A forward path comprising the following operationally connected units
  - An input unit for providing a time-domain electric input signal y(n) representing a sound signal in a full-band frequency range forming part of the audible human frequency range, n being a time-sample index,
  - An analysis filter bank configured to provide a time-frequency representation Y(k,m) of said electric input signal y(n), where k=1, 2, . . . , K is a frequency sub-band index, K being the number of frequency sub-bands, and each frequency sub-band signal Y(k, m) representing a frequency sub-band FBk of the full-band frequency range, and m is a time frame index,
  - A signal processing unit configured to execute one or more processing algorithms for processing a signal of the forward path in a number of processing channels, each comprising one or more of said frequency sub-bands, and providing a number of processed channel-signals, The hearing device further comprises

- An onset detector configured to receive said time-domain electric input signal y(n) or a signal derived therefrom before entering said analysis filter bank, and to determine a current first order derivative of said time-domain electric input signal y(n), or a signal derived therefrom, and to provide an onset control signal;
- A level estimation unit for estimating a current level of said frequency sub-band signals Y(k,m) or frequency sub-band signals derived therefrom, the level estimation unit comprising
  - A level adjustment unit configured to receive said frequency sub-band signals from the analysis filter bank, or signals derived therefrom, and to adjust their current levels, and to control said level adjustment in dependence of said onset control signal.

Thereby an improved hearing device may be provided.

In an embodiment, the hearing device further comprises a synthesis filter bank configured to convert said processed channel-signals to a time-domain electric signal representing a sound signal.

In an embodiment, the input unit is configured to provide the time-domain electric input signal y(n) as digitized samples with a first rate $F_{s1}$ corresponding to a sampling frequency $f_s$. In an embodiment, a predefined number of samples are arranged in a time frame, e.g. 64 or 128 time samples. In an embodiment, the sampling frequency fs is 20 kHz or larger.

In an embodiment, the onset detector is configured to provide the onset control signal at a second rate $F_{s2}$. In an embodiment, the rate at which the onset detector delivers the onset control signal is a second rate $F_{s2}$, smaller than the first rate $F_{s1}$.

In an embodiment, the onset detector comprises an envelope estimator unit comprising

- An ABS unit for providing a magnitude of the time-domain electric input signal y(n) or a signal derived therefrom at said first rate $F_{s1}$,
- A buffer unit of a buffer size D for buffering D samples of the magnitude of the time-domain electric input signal,
- A MAX unit for determining a maximum magnitude value among the D samples of the magnitude of the time-domain electric input signal presently stored in said buffer unit, wherein a maximum value is provided at a second rate $F_{s2}$ lower than said first rate $F_s$.

In an embodiment, the second rate $F_{s2}$ is equal to the ratio of the first rate $F_{s1}$ and said buffer size D ($F_{s2}=F_{s1}/D$).

In an embodiment, the onset detector comprises a LOG unit to convert an input signal to the logarithmic domain [dB]. In an embodiment, the LOG unit is connected to the MAX unit to provide the maximum values of the magnitude of the time-domain electric input signal the logarithmic domain [dB].

In an embodiment, the onset detector comprises a differentiator for determining said first order derivative of the envelope of said time-domain at electric input signal or a signal derived therefrom and to provide the onset control signal dependent thereon.

In an embodiment, the hearing device is configured to modify the onset control signal according to a predefined criterion.

In an embodiment, the hearing device is configured to modify said onset control signal according to a predefined criterion

- to be equal to a constant value, when the current value of said first order derivative is below an onset threshold value, and to be equal to the current value of said first order derivative, when it is above an onset threshold value.

In an embodiment, the constant value is zero. In an embodiment, the modification is performed in the level detector. In an embodiment, the modification is performed in the onset detector.

In an embodiment, the level estimation unit comprises a pre-smoothing unit for reducing large variance in the said frequency sub-band signals, or signals derived therefrom, and to provide pre-smoothed levels of said frequency sub-band signals. In an embodiment, the pre-smoothing unit comprises an ABS unit for providing a magnitude (or magnitude squared) of the frequency sub-band signals, or signals derived therefrom. In an embodiment, the pre-smoothing unit is electrically connected to and located before the level adjustment unit.

Thereby a better stability of the level estimate is provided in case of large variances in the electric input signal. In an embodiment, the level estimation unit comprises a LOG unit to convert an input signal to the logarithmic domain [dB].

In an embodiment, the hearing device comprises a configurable smoothing unit providing dynamically determined attack and release time-constants, which are applied in the determination of final level estimates of said frequency sub-band signals, or signals derived therefrom. In an embodiment, the configurable smoothing unit form part of the level estimation unit. In an embodiment, the configurable smoothing unit form part of the signal processing unit.

In an embodiment, the level adjustment unit is located between the pre-smoothing unit and the configurable smoothing unit.

In an embodiment, the level adjustment unit is configured to base the level adjustment on the level-change, which is given by the onset detector and the pre-smoothed level observed at the output of the pre-smoothing unit.

In an embodiment, the level adjustment unit is configured to maintain the adjusted level estimate at a certain level for a predefined time. In an embodiment, the predefined time is dependent on a delay of the analysis filter bank.

In an embodiment, the level adjustment unit is configured to keep the level estimate after the pre-smoother at a fixed level for a first time period (e.g. a predefined time), when an onset detected by the onset detector exceeds a certain threshold, wherein the fixed level value is determined in dependence of the level-increase which is given by the onset detector and the actual level observed at the pre-smoother output.

In an embodiment, the level adjustment unit is configured to provide that the level estimate returns to the pre-smoother level when the first time period (e.g. the predefined time) is exceeded or when the level at the pre-smoother output exceeds the adjusted level.

In an embodiment, the level adjustment unit comprises a counter and is configured to maintain the adjusted level estimate for a number of time frames smaller than a threshold number. In an embodiment, the predefined time and/or the threshold number of time frames is/are determined to provide that the resulting time is smaller than a delay of the analysis filter bank. In an embodiment, the level adjustment unit is configured to return to the adjusted level to the level of the pre-smoother unit when the counter has reached said threshold number or when said predefined time is exceeded, or when the level at the pre-smoother output exceeds the adjusted level.

In an embodiment, the signal processing unit is configured to receive said current level of said frequency sub-band signals Y(k,m) or frequency sub-band signals derived therefrom from said level estimation unit and to control said one or more processing algorithms in dependence thereof. In an embodiment, the one or more processing algorithms comprise a compression algorithm, maximum power output algorithm, a transient noise reduction algorithm, or the like.

In an embodiment, the hearing device comprises a hearing aid (e.g. a hearing instrument), a headset, an ear protection device or a combination thereof.

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal.

In an embodiment, the hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the hearing device comprises an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound. In an embodiment, the hearing device comprises a directional microphone system adapted to spatially filter sounds from the environment, and thereby enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art.

In an embodiment, the hearing device comprises an antenna and transceiver circuitry for wirelessly receiving a direct electric input signal from another device, e.g. a communication device or another hearing device.

In an embodiment, the communication between the hearing device and the other device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 50 GHz, e.g. located in a range from 50 MHz to 50 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of frequency bands, where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing assistance device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain).

In an embodiment, the number of detectors comprises a level detector for estimating a current level of a signal of the forward path. In an embodiment, the predefined criterion comprises whether the current level of a signal of the forward path is above or below a given (L-)threshold value.

In a particular embodiment, the hearing device comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice.

Alternatively, the voice detector is adapted to exclude a user's own voice from the detection of a VOICE.

In an embodiment, the hearing device comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the hearing assistance device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic;

b) the current acoustic situation (input level, feedback, etc.), and c) the current mode or state of the user (movement, temperature, etc.);

d) the current mode or state of the hearing assistance device (program selected, time elapsed since last user interaction, etc.) and/or of another device in communication with the hearing device.

In an embodiment, the hearing device further comprises other relevant functionality for the application in question, e.g. compression, noise reduction, feedback detection and/or reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing device as described above, in the 'detailed description of embodiments' and in the claims, is moreover provided. In an embodiment, use is provided in a system comprising audio distribution. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Method:

In an aspect, a method of operating a hearing device, e.g. a hearing aid, is furthermore provided by the present application. The method comprises providing a time-domain electric input signal y(n) representing a sound signal in a full-band frequency range forming part of the audible human frequency range, n being a time-sample index;

converting said electric input signal y(n) to a time-frequency representation Y(k,m), where k=1, 2, . . . , K is a frequency sub-band index, K being the number of frequency sub-bands, and each frequency sub-band signal Y(k,m) representing a frequency sub-band $FB_k$ of the full-band frequency range, and m is a time frame index;

executing one or more processing algorithms for processing a signal of the forward path in a number of processing channels, each comprising one or more of said frequency sub-bands, and providing a number of processed channel-signals;

The method further comprises determining a current first order derivative of said time-domain electric input signal y(n), or a signal derived therefrom before said conversion to a time-frequency representation Y(k,m), and providing an onset control signal;

estimating a current level of said frequency sub-band signals Y(k,m) or frequency sub-band signals derived therefrom, adjusting the current levels of said frequency sub-band signals, or signals derived therefrom, and controlling said level adjustment in dependence of said onset control signal.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

In an embodiment, the method comprises converting the processed channel-signals to a time-domain electric signal representing a sound signal.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

In an embodiment, the system is adapted to establish a communication link between the hearing device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is another hearing device. In an embodiment, the hearing system comprises two hearing devices adapted to implement a binaural hearing system, e.g. a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system. In an embodiment, the APP implements a Level Adjustment APP configured to control or influence parameters related to a current onset detection and adaptive level adjustment, e.g. attack and release coefficients of a low pass filter (cf. e.g. $1^{st}$ Order IIR LP Smoothing in FIG. 1A).

Definitions

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing devices, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

Embodiments of the disclosure may e.g. be useful in applications such as hearing aids, headsets, ear phones, active ear protection systems or combinations thereof. The disclosure may further be useful in audio processing devices comprising signal processing frequency sub-bands where filter banks in's involved, e.g. in communication devices, such as mobile telephones, etc.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1A:
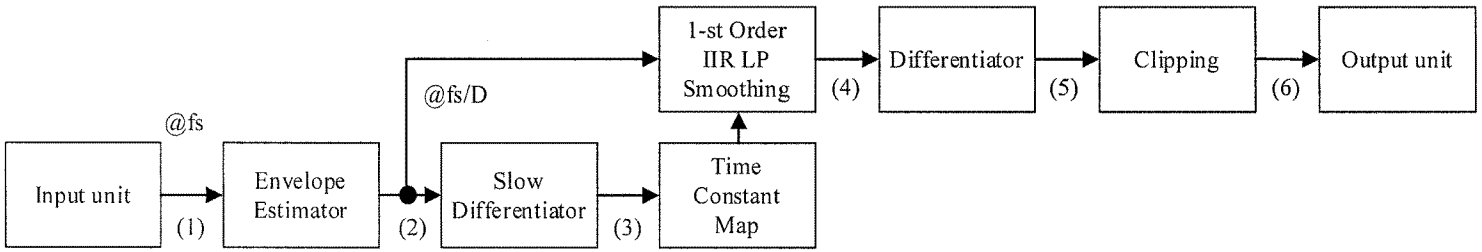
FIG. 1A shows a first embodiment of an onset detector for a hearing device according to the present disclosure.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids, and in particular to devices and methods for improving temporal performance of time-frequency signal processing.

Signal processing algorithms that operate in the time-frequency domain suffer from the fact that filtering into sub-bands as done with filter banks leads to temporal smearing of very-short-in-time input signals such as transients. Examples of such time-frequency processing is noise reduction, dynamic range compression and output power limiting in hearing aids. All these algorithms use level estimation in some form. Level estimation based on filter bank sub-bands suffers from time delay in the analysis stage, even when the fastest possible time constants are used in the level estimator. This means that input-dependent gain may not be on time and the processed signal may be corrupted with overshoot artefacts. The problem increases with higher frequency resolution and higher number of sub-bands, A solution to this problem may be to adjust a level estimator, based on the input signal to the filter bank. The level estimator usually consists of a pre-smoother that reduces large variance at the input and a smoother that gives the correct time-constant behaviour of the final level estimate. This consists of two parts. 1. Onset Detection and 2. Level Adjustment.

1. Onset Detection

An onset-detector is used on the input. The onset detector does the following. If the first-order derivative of the input signal envelope exceeds a threshold, the level increase is passed on as the onset-detector output.

FIG. 1A shows a first embodiment of an onset detector for a hearing device according to the present disclosure.

Input Unit:

The onset detector comprises an input unit (denoted Input unit in FIG. 1A and box symbol □ in FIG. 1B) for providing a time-domain electric input signal y(n) (where n is a time-sample index) as digital samples at a first rate $F_{s1}$ (corresponding to a sampling frequency of $f_s$, e.g. 10 kHz or more, e.g. 20 kHz or more). The electric input signal y(n) represents a sound signal in a full-band frequency range (e.g. ~0 Hz to 8 kHz) forming part of the human audible frequency range (20 Hz to 20 kHz). The output of the Input unit is time-domain electric Input Signal y(n) and is denoted (1) in FIGS. 1A and 1B. An example of Input Signal (1) (Amplitude versus Time [ms]) is given in FIG. 3A (for a time range 0-1000 ms) and in FIG. 4A (as FIG. 3A but only for the time range 160-190 ms) as the Input Signal (1) in the top, left graph of FIGS. 3A and 4A.

Envelope Estimator

Figure 3A:
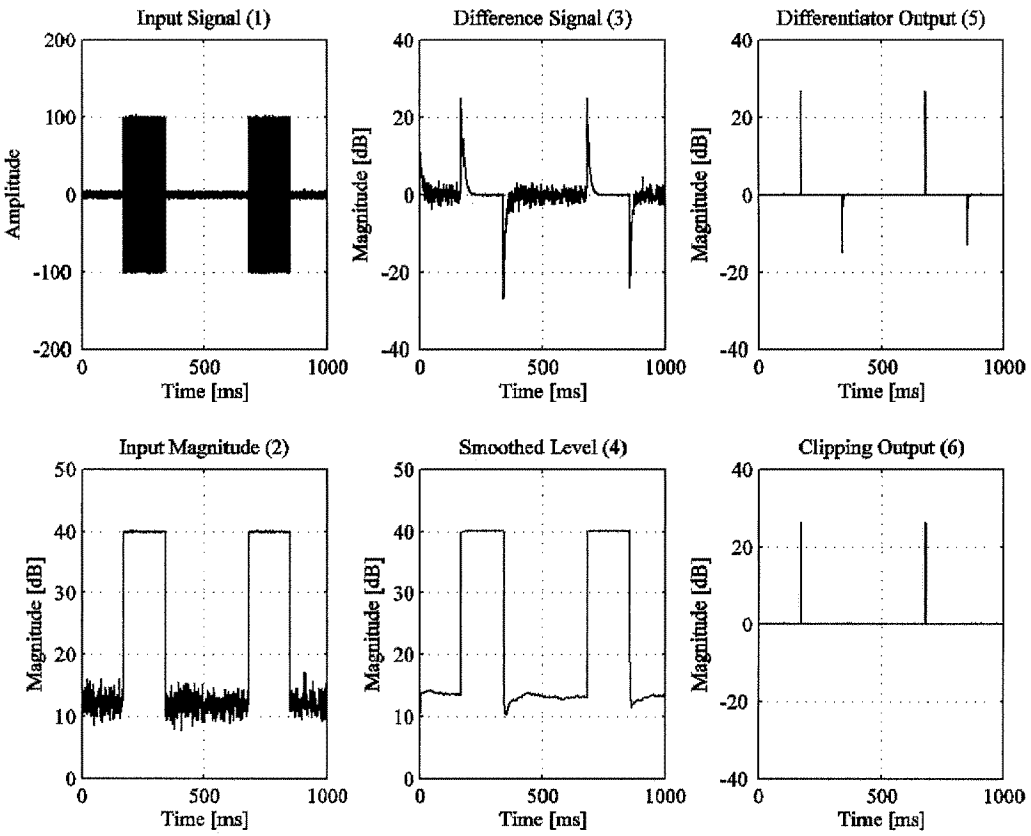
FIG. 3A shows an example of signals involved in detection of an onset of a signal comprising modulation (e.g. speech) in a time range spanning 1 s (1000 ms)
Figure 4A:
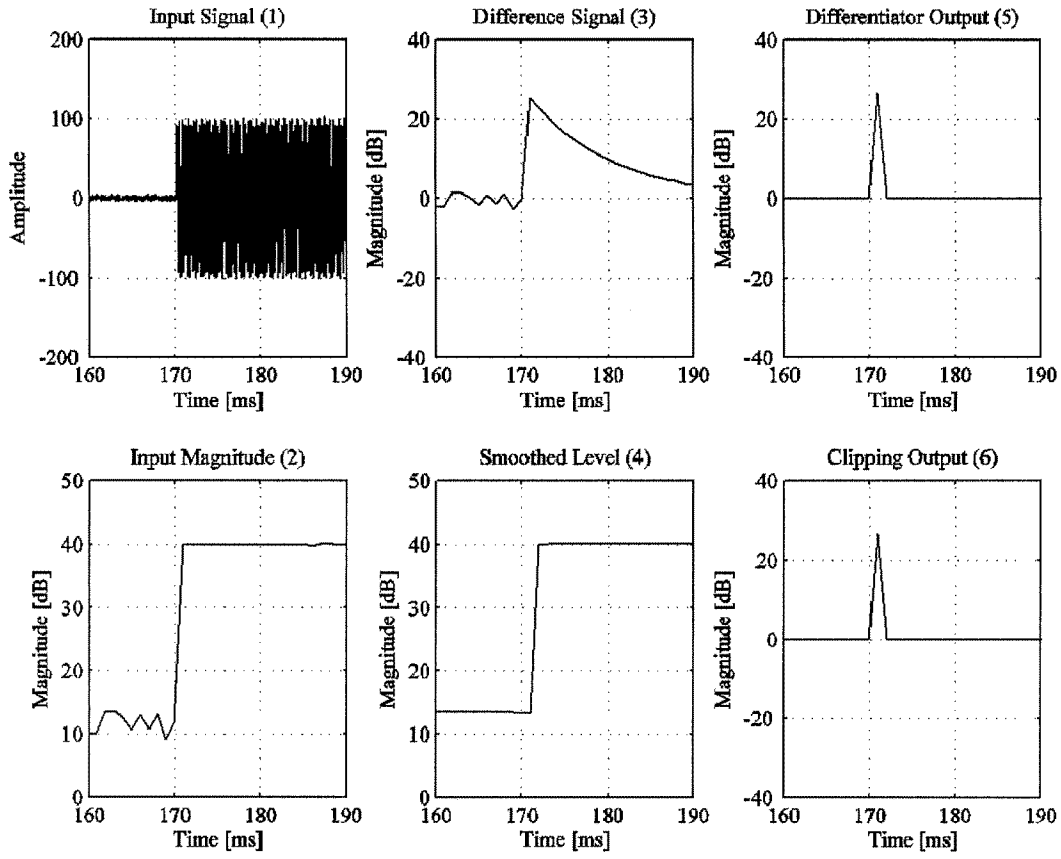
FIG. 4A shows a time segment between time=160 ms and time=190 ms of the signals of FIG. 3A.

The onset detector of FIG. 1A further comprises an envelope estimator unit (Envelope Estimator in FIG. 1A). The purpose of the envelope estimator is to provide a fast estimate of the input signal magnitude at the same rate at in which the onset detector delivers its output. The operations used are ABS, Buffer, Max and LOG (cf. FIG. 1B). The ABS operation calculates the signal magnitude at $F_s$ sample rate, the buffer collects a number of D samples and the max operation takes the largest in the buffer before it is filled with new values. The maximum value comes therefore at a sample rate of $F_s/D$. Finally the logarithm is taken to convert the magnitude into a dB scale. The output of the envelope estimator unit is denoted (2) (@fs/D) in FIGS. 1A and 1B. An example of an output of the Envelope Estimator unit (Magnitude [dB] versus Time [ms]) showing an envelope of the time-domain electric input signal y(n) (Input Signal (1)) as given in FIGS. 3A and 4A is shown as the Input Magnitude (2) in the bottom, left graph of FIGS. 3A and 4A.

Slow Differentiator

The onset detector of FIG. 1A further comprises a slow differentiator unit (Slow Differentiator in FIG. 1A). The slow differentiator takes the fast envelope estimate as its input. It calculates the difference between a smoothed version of the envelope and the envelope itself. This means that desired fast variations in the envelope are filtered out of the envelope signal. The output of the slow differentiator unit is denoted (3) in FIGS. 1A and 1B. An example of an output of the Slow Differentiator unit (Magnitude [dB] versus Time [ms]) resulting from the envelope signal Input Magnitude (2) as given in FIGS. 3A and 4A is shown as the Difference signal (3) in the top, middle graph of FIGS. 3A and 4A.

Time Constant Map and 1-St Order IIR LP Smoothing

The onset detector of FIG. 1A further comprises a time constant mapping unit (Time Constant Map in FIG. 1A) for determining appropriate time constants (e.g. attack and release time constants) of a smoothing filtering unit (1-st Order IIR LP Smoothing). The fast variations of the envelope (output of the Envelope Estimator unit) are then used to control a smoothing filter (1-st Order IIR LP Smoothing) in the envelope signal, such that the envelope is smoothed when it contains small variations and not smoothed when there are large variations, this means that small variations (noise variance) are removed from the envelope estimate and large variations (signal onsets and offsets) are maintained. The output of the 1-st Order IIR LP Smoothing unit is denoted (4) in FIGS. 1A and 1B. An example of an output of the 1-st Order IIR LP Smoothing unit (Magnitude [dB] versus Time [ms]) resulting from the Difference signal (3) and the Input Magnitude (2) as given in FIGS. 3A and 4A is shown as the Smoothed Level (4) in the bottom, middle graph of FIGS. 3A and 4A.

Differentiator

The onset detector of FIG. 1A further comprises a differentiator unit (Differentiator in FIG. 1A) for providing a time derivative of an input signal. A differentiator calculates the difference between the current input values and the previous input value. By doing this, onsets and offsets are captured from the smoothed envelope signal and occur as spikes in the differentiator output. (positive spikes for onsets, and negative spikes for offsets). The value of the spikes represent the level of change in the input signal magnitude. The output of the Differentiator unit is denoted (5) in FIGS. 1A and 1B. An example of an output of the Differentiator unit (Magnitude [dB] versus Time [ms]) resulting from the Smoothed Level (4) as given in FIGS. 3A and 4A is shown as the Differentiator Output (5) in the top, right graph of FIGS. 3A and 4A.

Clipping

The onset detector of FIG. 1A further comprises a clipping unit (Clipping in FIG. 1A) for providing a limitation of an input signal to a certain magnitude range. Clipping is e.g. used to let positive spikes through and block negative spikes, as to only let information on onsets be passed through and to block information on offsets. The output of the Differentiator unit is denoted (6) in FIGS. 1A and 1B. An example of an output of the Clipping unit (Magnitude [dB] versus Time [ms]) resulting from the Differentiator Output (5) as given in FIGS. 3A and 4A is shown as the Clipping Output (6) in the bottom, right graph of FIGS. 3A and 4A.

An Example of an Onset Detector Implementation

Figure 1B:
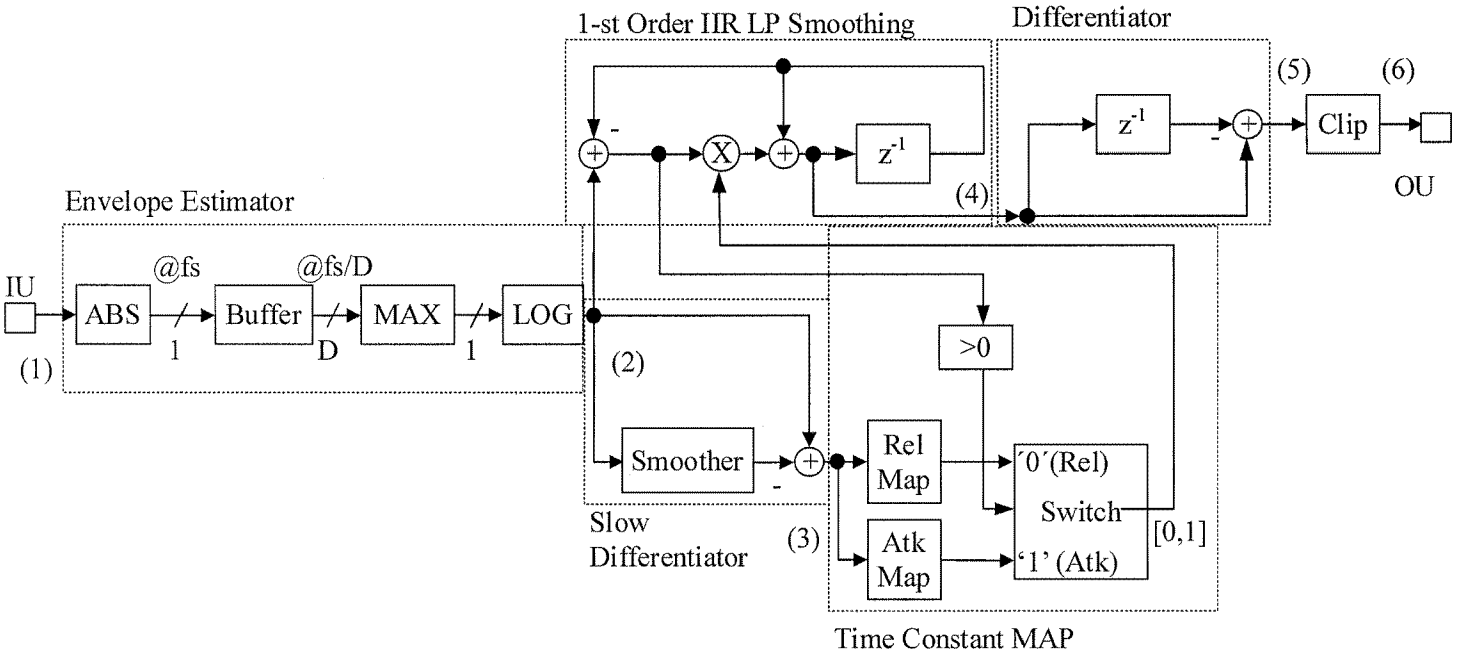
FIG. 1B shows a second embodiment of an onset detector for a hearing device according to the present disclosure.

FIG. 1B shows a second embodiment of an onset detector for a hearing device according to the present disclosure, where some of the units of the embodiment of FIG. 1A are further detailed out. The embodiments of the blocks that are detailed out in FIG. 1B, are enclosed by dotted rectangles with the same names as in FIG. 1A. The various nodes (1)-(6) (for which examples of corresponding signals are illustrated in FIGS. 3A and 4A) are also indicated in FIG. 1B.

The Envelope Estimator unit of FIG. 1A is e.g. embodied in units ABS, Buffer, MAX, and LOG. The purpose of these blocks is to take the envelope of the electric input signal (Input signal (1) in FIG. 3A and FIG. 4A), buffer D samples of the signal, take the maximum value from the buffer each time the buffer is filled with new values and finally calculate the magnitude in dB (cf. Input Magnitude (2) in FIG. 3A and FIG. 4A).

The Slow Differentiator unit in FIG. 1A is e.g. embodied by Smoother unit and sum unit '+' in FIG. 1B. The embodiment of the Slow Differentiator in FIG. 1B (and the following time constant mapping units) is configured to smooth the input signal magnitude (signal (2)) by input-controlled smoothing such that onsets pass through immediately and a release mechanism controls how fast the next onset may pass through. The first order derivative of the smoothed magnitude is taken and passed on as the detector output. The output value is a measure of magnitude of the onset. The value is only passed on when it exceeds a certain threshold, otherwise the detector output is zero.

The Time Constant Map unit in FIG. 1A in FIG. 1A is e.g. embodied in FIG. 1B by discrimination unit denoted '>', release time map Rel Map and attack time map Atk Map units, and switch unit Switch for providing appropriate release times and attack times to the 1-st order IIR LP Smoothing unit via combination unit (here multiplication unit) 'X'. The discrimination unit determines whether the input signal increases or decreases and thus determines whether the Switch unit is in release '0' or attack 1' mode. The release time map Rel Map and attack time map Atk Map units (adaptively) provide appropriate current values of attack and release times, respectively, in dependence of the current incremental level changes (denoted (3) in FIGS. 1A and 1B and shown as Difference Signal (3) in FIGS. 3A and 4A). The attack time and release time maps are e.g. step like maps that provide larger attack and release times at smaller current incremental level changes and smaller attack and release times at higher current incremental level changes. This results in the 1-st order IIR LP Smoothing unit providing slower smoothing at lower incremental level changes and faster smoothing at higher incremental level changes. A transition between lower and higher values of attack and release times may be binary (step-like) or linear with a predetermined slope or curved (decreasing time constants with increasing incremental level changes). The maps for attack and release times may be equal or different. In an embodiment the value of the incremental level changes where the time constant starts to decrease is higher for the release time map than for the attack time map.

The 1-st Order IIR LP Smoothing unit in FIG. 1A is e.g. embodied in FIG. 1B by delay unit $z^{-1}$ and combination units '+' and 'X' implementing an IIR low pass filter with configurable smoothing coefficient via output [0, 1] from the Switch unit of the time constant mapping unit to the multiplication unit 'X' of the IIR filter.

The Differentiator unit is in FIG. 1A is e.g. embodied in FIG. 1B by delay unit $z^{-1}$ and combination unit '+', which provide a difference of the input level between a value at given time unit and the value at the preceding time unit.

The Input unit, the Clipping unit, and the Output unit in FIG. 1A are not further detailed out in FIG. 1B.

Figure 2:
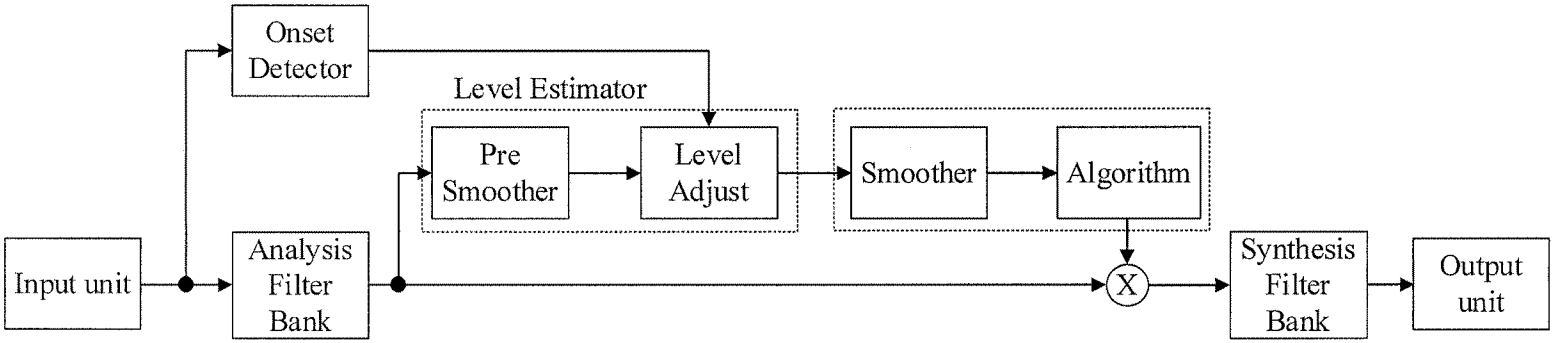
FIG. 2 shows an embodiment of a hearing device comprising an onset detector and a level adjustment unit according to the present disclosure.

FIG. 2 shows an embodiment of a hearing device comprising an onset detector and a level adjustment unit according to the present disclosure.

A hearing device, e.g. a hearing aid, may e.g. comprise a forward path comprising an input unit (cf. Input unit in FIG. 2), e.g. a microphone, and an analysis filter bank (cf. Analysis Filter Bank in FIG. 2) configured to provide a time-frequency representation Y(k,m) of the electric input signal y(n), where k=1, 2, . . . , K is a frequency sub-band index, and K is the number of frequency sub-bands. Each frequency sub-band signal Y(k,m) represents a frequency sub-band $FB_k$ of the full-band frequency range (e.g. 0 to 8 kHz), and m is a time frame index. The forward path further comprises a combination unit (cf. multiplication unit 'x' in FIG. 2) for applying a resulting gain (or attenuation) to the electric input signal Y(k,m) and providing processed channel signals (e.g. for compensating for a user's hearing impairment), and a synthesis filter bank (cf. Synthesis Filter Bank in FIG. 2) configured to convert said processed channel-signals to a time-domain electric signal representing a sound signal. The forward path further comprises an output unit (cf. Output unit in FIG. 2) for converting the time-domain electric signal to output stimuli perceivable to a user as sound.

Level Adjustment

A Level Estimator (cf. dashed block in FIG. 2) normally consists of ABS (or ABS Square), smoothing and dB conversion operations. Level adjustment is proposed in such a way that the smoothing operation includes a pre-smoother (cf. Pre Smoother in FIG. 2) and a level adjustment stage (cf. unit Level Adjust in FIG. 2), prior to the final smoothing (cf. unit Smoother in FIG. 2). The final smoothing is typically integrated with the gain conversion algorithm (Algorithm in FIG. 2, e.g. a compressive amplification algorithm) as indicated by dashed outline around the Smoother and Algorithm blocks in FIG. 2. The time constants of the final smoothing may be fixed or adaptive (configurable), e.g. in dependence of the input signal (e.g. its level, or change in level), or in dependence of parameters related to the input signal (e.g. SNR). In an embodiment, the final smoothing unit (Smoother in FIG. 2) have fixed attack and release times, but different in different frequency bands, and/or the band coupling may be adaptively determined (e.g. in dependence of the input signal or characteristics of the input signal).

When an onset is detected (i.e. the value from the onset detector ((cf. Onset Detector unit in FIG. 2) exceeds a certain threshold), the level estimate after the pre-smoother is kept at a certain level during a certain time (preferably related to the delay of the analysis filter bank, cf. Analysis Filter Bank in FIG. 2). This fixed level value is based on the level-increase which is given by the onset detector and the actual level observed at the pre-smoother output. This level value is e.g. kept for a number of frames, e.g. using a counter. The level returns to the pre-smoother level when the counter has stopped counting or when the level at the pre-smoother output exceeds the adjusted level.

The following parameters can be used to control the behavior of this mechanism:

- Onset threshold; this parameter controls which level-increase to be regarded as onsets;
- Frame counter; this parameter controls for how many frames an adjustment should be hold (should at least correspond to the filter bank delay).

More parameters can be added to the system, in order to fine-tune the behavior.

In an embodiment, a single onset detector can be reused to supply the adjustment for multiple level estimators, possibly having different criteria for using the output of the onset detector (e.g. different thresholds for the clipping unit Clipping in FIG. 1A, 1B, which may form part of the Level Estimator instead of the Onset Detector).

FIG. 3A shows an example of signals involved in detection of an onset of a signal comprising modulation (e.g. speech) in a time range spanning 1 s (1000 ms).

The 6 graphs of FIG. 3A correspond to corresponding signals of nodes (1)-(6) of the block diagrams of FIGS. 1A and 1B and are described in connection therewith.

Figure 3B:
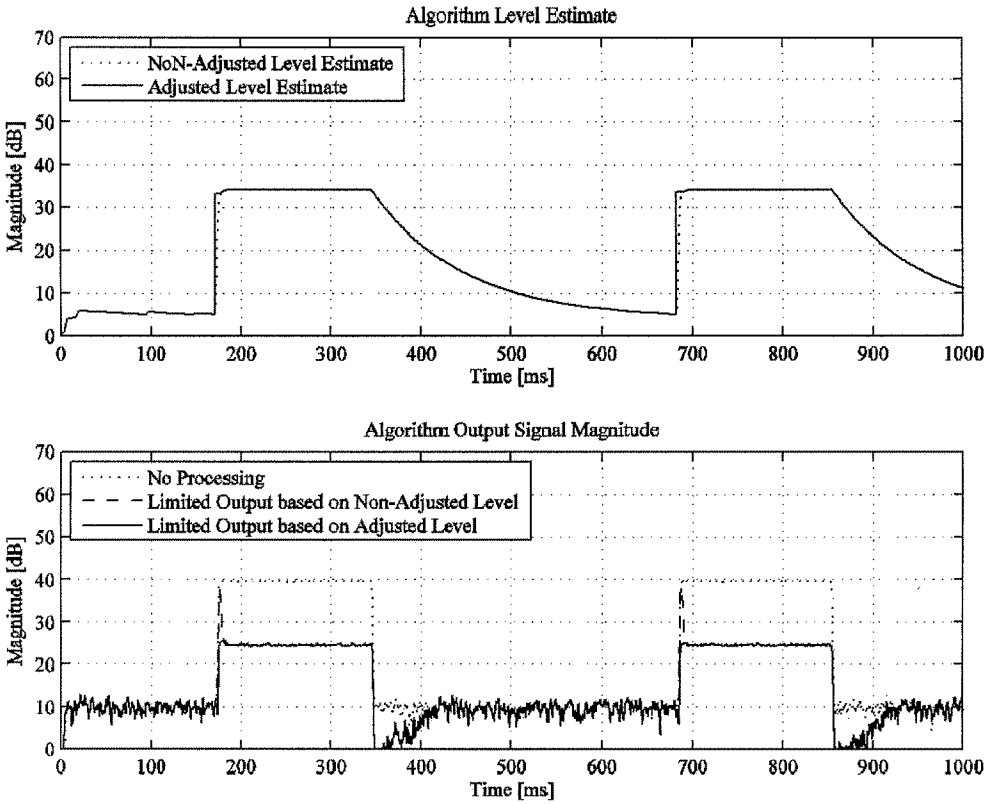
FIG. 3B shows an example of the adjusted level and the resulting output signal for a power output limitation algorithm (MPO) exploiting the adjusted level estimate according to the present disclosure contra the non-adjusted level estimate in the time range of FIG. 3A.

FIG. 3B shows an example of the adjusted level and the resulting output signal (Magnitude [dB]) for a power output limitation algorithm (MPO) exploiting the adjusted level estimate according to the present disclosure contra the non-adjusted level estimate in the time range of FIG. 3A (1000 ms).

The two graphs of FIG. 3B illustrate the effect of onset detection and level adjustment as proposed in the present disclosure when exposed to an input signal as shown in FIG. 3A (Input Signal (1)).

The top graph shows in solid line the adjusted level estimate provided by the scheme of the present disclosure, whereas the dotted graph illustrates a non-adjusted level estimate. It appears that the adjusted level provides a level adjustment of the onset of the signal (as even more clearly observed in the focused view of FIG. 4B).

The bottom graph shows the non adjusted and adjusted output signals. The dotted graph illustrates an output signal that is not subject to processing. The dashed graph illustrates an output signal that is subject to processing but not to level adjustment. The solid graph illustrates an output signal that has been subject to processing and level adjustment according to the present disclosure. It is clear that the onset detection and level adjustment according to the present disclosure removes the spike like overshoot of the non-adjusted signal (dashed graph). In other words, the algorithm or device according to the present disclosure is able to control the gain such that overshoot at the output can be avoided.

Examples of algorithms that can exploit level-adjustment are dynamic range compression, maximum power output limiters, fast noise reduction and transient noise reduction and other algorithms that process signals in the time-frequency domain.

Figure 4B:
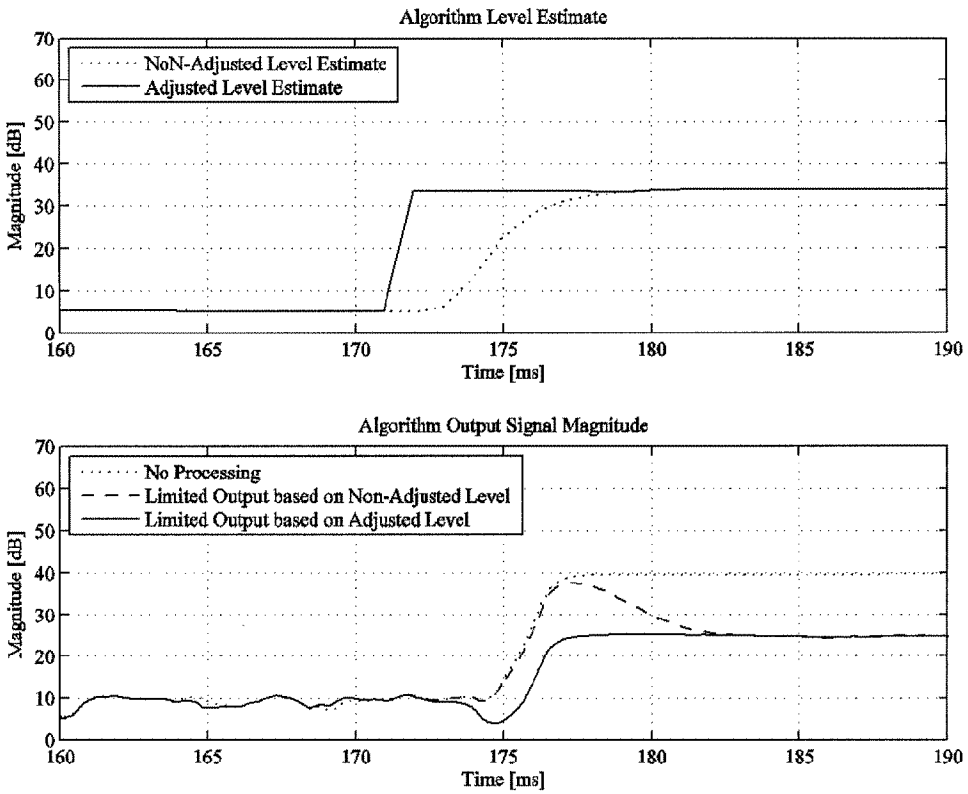
FIG. 4B shows a time segment between time=160 ms and time=190 ms of the signals of FIG. 3B.

FIG. 4A shows a time segment between time=160 ms and time=190 ms of the signals of FIG. 3A, and FIG. 4B shows a time segment between time=160 ms and time=190 ms of the signals of FIG. 3B.

The 6 graphs of FIG. 4A correspond to corresponding signals of nodes (1)-(6) of the block diagrams of FIGS. 1A and 1B and are described in connection therewith.

The two graphs of FIG. 4B illustrate a focused segment FIG. 3B at an onset around 160 ms to 190 ms. The results have been discussed in connection with FIG. 3B but are more clearly visible in FIG. 4B.

Figure 5:
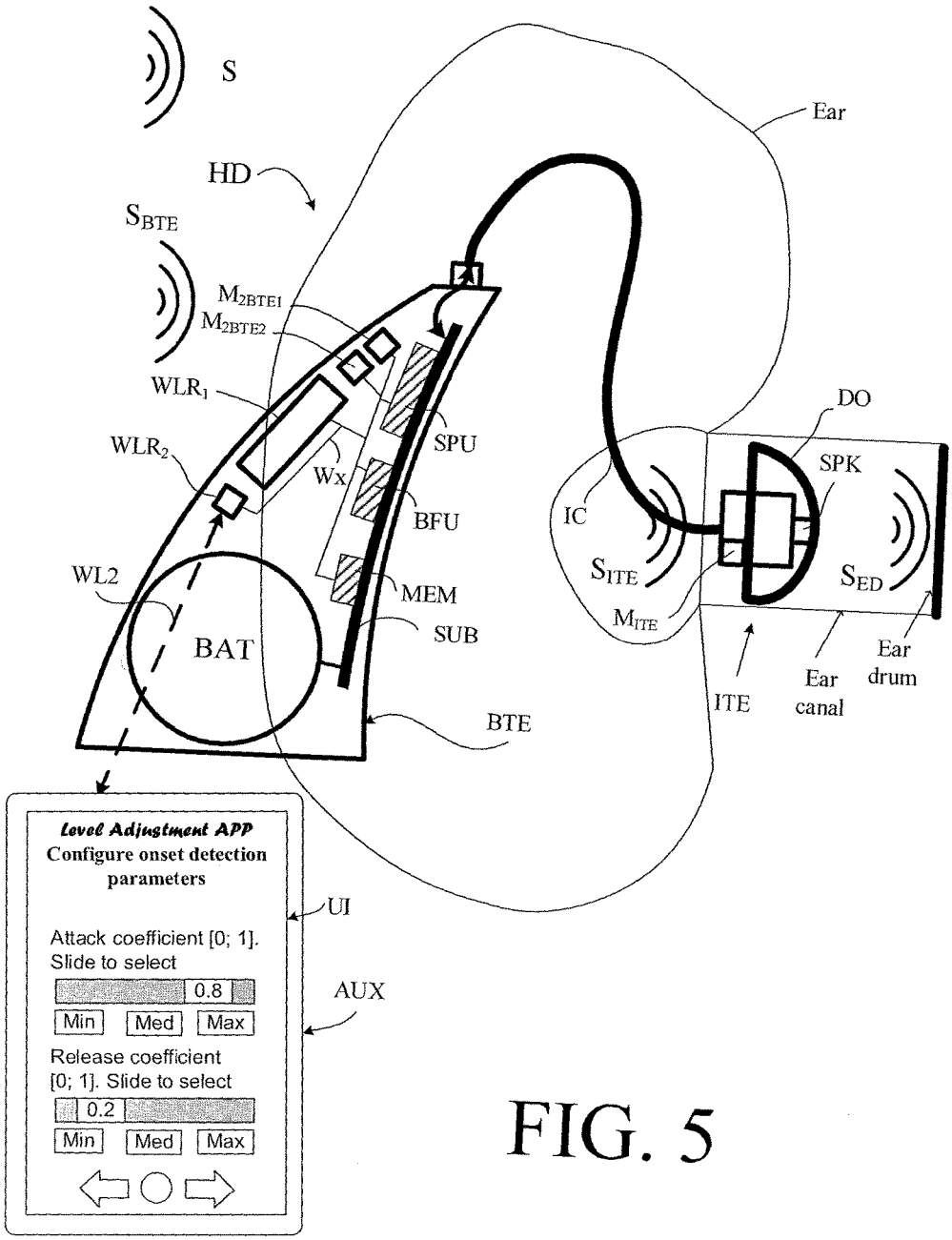
FIG. 5 shows an embodiment of a hearing aid according to the present disclosure comprising a BTE-part located behind an ear or a user and an ITE part located in an ear canal of the user.

FIG. 5 shows an embodiment of a hearing aid according to the present disclosure comprising a BTE-part located behind an ear or a user and an ITE part located in an ear canal of the user.

FIG. 5 shows an embodiment of a hearing aid according to the present disclosure comprising a BTE-part located behind an ear or a user and an ITE part located in an ear canal of the user.

FIG. 5 illustrates an exemplary hearing aid (HD) formed as a receiver in the ear (RITE) type hearing aid comprising a BTE-part (BTE) adapted for being located behind pinna and a part (ITE) comprising an output transducer (e.g. a loudspeaker/receiver, SPK) adapted for being located in an ear canal (Ear canal) of the user (e.g. exemplifying a hearing aid (HD) as shown in FIGS. 13A, 13B). The BTE-part (BTE) and the ITE-part (ITE) are connected (e.g. electrically connected) by a connecting element (IC). In the embodiment of a hearing aid of FIG. 5, the BTE part (BTE) comprises two input transducers (here microphones) ($M_{BTE1}$, $M_{BTE2}$) each for providing an electric input audio signal representative of an input sound signal ($S_{BTE}$) from the environment. In the scenario of FIG. 5, the input sound signal $S_{BTE}$ includes a contribution from sound source S, S being e.g. sufficiently far away from the user (and thus from hearing device HD) so that its contribution to the acoustic signal $S_{BTE}$ is in the acoustic far-field. The hearing aid of FIG. 5 further comprises two wireless receivers ($WLR_1$, $WLR_2$) for providing respective directly received auxiliary audio and/or information signals. The hearing aid (HD) further comprises a substrate (SUB) whereon a number of electronic components are mounted, functionally partitioned according to the application in question (analogue, digital, passive components, etc.), but including a configurable signal processing unit (SPU), a beam former filtering unit (BFU), and a memory unit (MEM) coupled to each other and to input and output units via electrical conductors Wx. The mentioned functional units (as well as other components) may be partitioned in circuits and components according to the application in question (e.g. with a view to size, power consumption, analogue vs. digital processing, etc.), e.g. integrated in one or more integrated circuits, or as a combination of one or more integrated circuits and one or more separate electronic components (e.g. inductor, capacitor, etc.). The configurable signal processing unit (SPU) provides an enhanced audio signal, which is intended to be presented to a user. In the embodiment of a hearing aid device in FIG. 5, the ITE part (ITE) comprises an output unit in the form of a loudspeaker (receiver) (SPK) for converting the electric signal (OUT) to an acoustic signal (providing, or contributing to, acoustic signal $S_{ED}$ at the ear drum (Ear drum). In an embodiment, the ITE-part further comprises an input unit comprising an input transducer (e.g. a microphone) ($M_{ITE}$) for providing an electric input audio signal representative of an input sound signal $S_{ITE}$ from the environment (including from sound source S) at or in the ear canal. In another embodiment, the hearing aid may comprise only the BTE-microphones ($M_{BTE1}$, $M_{BTE2}$). In another embodiment, the hearing aid may comprise only the ITE-microphone ($M_{ITE}$). In yet another embodiment, the hearing aid may comprise an input unit ($IT_3$) located elsewhere than at the ear canal in combination with one or more input units located in the BTE-part and/or the ITE-part. The ITE-part further comprises a guiding element, e.g. a dome, (DO) for guiding and positioning the ITE-part in the ear canal of the user.

The hearing aid (HD) exemplified in FIG. 5 is a portable device and further comprises a battery (BAT) for energizing electronic components of the BTE- and ITE-parts.

The hearing aid (HD) may e.g. comprise a directional microphone system (beam former filtering unit (BFU)) adapted to enhance a target acoustic source among a multitude of acoustic sources in the local environment of the user wearing the hearing aid device. In an embodiment, the directional system is adapted to detect (such as adaptively detect) from which direction a particular part of the microphone signal (e.g. a target part and/or a noise part) originates. In an embodiment, the beam former filtering unit is adapted to receive inputs from a user interface (e.g. a remote control or a smartphone) regarding the present target direction. The memory unit (MEM) may e.g. comprise predefined (or adaptively determined) complex, frequency dependent constants ($W_{ij}$) defining predefined or (or adaptively determined) 'fixed' beam patterns (e.g. omni-directional, target cancelling, etc.), together defining the beamformed signal $Y_{BF}$.

The hearing aid of FIG. 5 may constitute or form part of a hearing aid and/or a binaural hearing aid system according to the present disclosure. The hearing aid comprises an analysis filter bank and an onset detector and level adjustment unit as described above. The processing of an audio signal in a forward path of the hearing aid may e.g. be performed fully or partially in the time-frequency domain. Likewise, the processing of signals in an analysis or control path of the hearing aid may be fully or partially performed in the time-frequency domain.

The hearing aid (HD) according to the present disclosure may comprise a user interface UI, e.g. as shown in FIG. 5 implemented in an auxiliary device (AUX), e.g. a remote control, e.g. implemented as an APP in a smartphone or other portable (or stationary) electronic device. In the embodiment of FIG. 5, the screen of the user interface (UI) illustrates a Level Adjustment APP. Parameters that govern or influence the current onset detection and adaptive level adjustment, here attack and release coefficients of the low pass filter ($1^{st}$ Order IIR LP Smoothing in FIG. 1A) (cf. discussion in connection with FIG. 1A, 1B) can be controlled via the Level Adjustment APP (with the subtitle: 'Configure onset detection parameters'). The smoothing parameters 'Attack coefficient' and 'release coefficient' can be set via respective sliders to a value between a minimum value (0) and a maximum value (1).

The currently set values (here 0.8 and 0.2, respectively) are shown on the screen at the location of the slider on the (grey shaded) bar that span the configurable range of values. The arrows at the bottom of the screen allow changes to a preceding and a proceeding screen of the APP, and a tab on the circular dot between the two arrows brings up a menu that allows the selection of other APPs or features of the device.

The auxiliary device and the hearing aid are adapted to allow communication of data representative of the currently selected direction (if deviating from a predetermined direction (already stored in the hearing aid)) to the hearing aid via a, e.g. wireless, communication link (cf. dashed arrow WL2 in FIG. 5). The communication link WL2 may e.g. be based on far field communication, e.g. Bluetooth or Bluetooth Low Energy (or similar technology), implemented by appropriate antenna and transceiver circuitry in the hearing aid (HD) and the auxiliary device (AUX), indicated by transceiver unit $WLR_2$ in the hearing aid.

Figure 6:
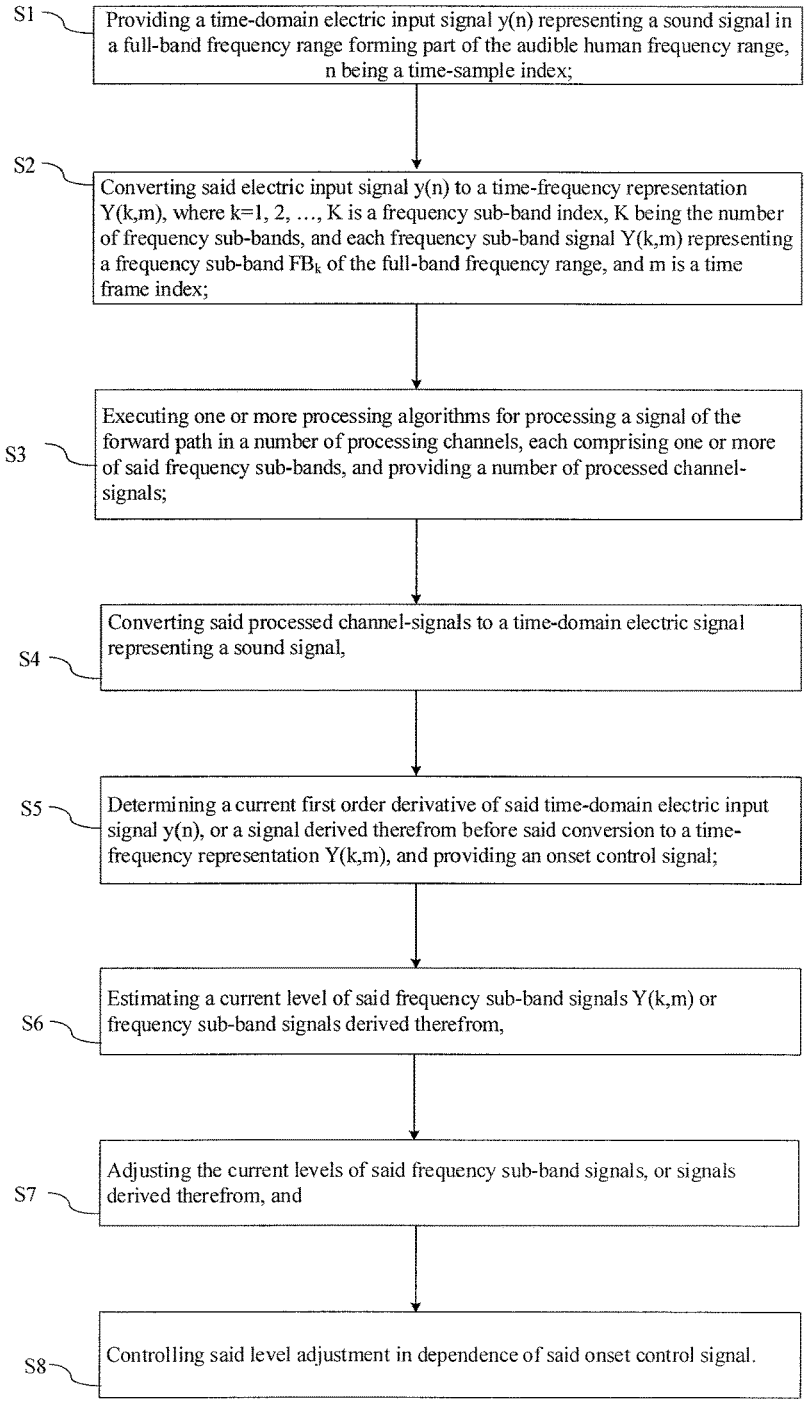
FIG. 6 shows a flow diagram for a method of operating a hearing device, e.g. a hearing aid according to the present disclosure.

FIG. 6 shows a flow diagram for a method of operating a hearing device, e.g. a hearing aid according to the present disclosure.

The method comprises

S1. providing a time-domain electric input signal y(n) representing a sound signal in a full-band frequency range forming part of the audible human frequency range, n being a time-sample index;

S2. converting said electric input signal y(n) to a time-frequency representation Y(k,m), where k=1, 2, . . . , K is a frequency sub-band index, K being the number of frequency sub-bands, and each frequency sub-band signal Y(k,m) representing a frequency sub-band $FB_k$ of the full-band frequency range, and m is a time frame index;

S3. executing one or more processing algorithms for processing a signal of the forward path in a number of processing channels, each comprising one or more of said frequency sub-bands, and providing a number of processed channel-signals;

S4. converting said processed channel-signals to a time-domain electric signal representing a sound signal, S5. determining a current first order derivative of said time-domain electric input signal y(n), or a signal derived therefrom before said conversion to a time-frequency representation Y(k,m), and providing an onset control signal;

S6. estimating a current level of said frequency sub-band signals Y(k,m) or frequency sub-band signals derived therefrom, S7. adjusting the current levels of said frequency sub-band signals, or signals derived therefrom, and S8. controlling said level adjustment in dependence of said onset control signal.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

U.S. Pat. No. 8,929,574B2 (Widex) Mar. 11, 2011

The invention claimed is:

1. A hearing device, comprising a forward path, at least comprising the following operationally connected units an input unit for providing a time-domain electric input signal y(n) as digital samples at a first rate $F_{s1}$, said electric input signal y(n) representing a sound signal in a full-band frequency range forming part of the human audible frequency range, n being a time-sample index, an analysis filter bank configured to provide a time-frequency representation Y(k,m) of said electric input signal y(n), where k=1, 2, . . . , K is a frequency sub-band index, K being the number of frequency sub-bands, and each frequency sub-band representing a frequency sub-band $FB_k$ of the full-band frequency range, and m is a time frame index, a signal processing unit configured to execute one or more processing algorithms for processing a signal of the forward path in a number of processing channels, each processing channel comprising one or more of said frequency sub-bands, and providing a number of processed channel-signals, wherein the hearing device further comprises an onset detector configured to receive said time-domain electric input signal y(n) before entering said analysis filter bank, and to determine a current first order derivative of an envelope of said time-domain electric input signal y(n), or a signal derived therefrom, and to provide an onset control signal dependent thereon;

a level estimation unit for estimating a current level of said frequency sub-band signals Y(k,m) or frequency sub-band signals derived therefrom, the level estimation unit comprising a level adjustment unit configured to receive said frequency sub-band signals from the analysis filter bank, or signals derived therefrom, and to adjust their current levels, and to control a level adjustment in dependence of said onset control signal.

2. A hearing device according to claim 1 wherein the onset detector is configured to provide the onset control signal at a second rate $F_{s2}$.

3. A hearing device according to claim 1 wherein the onset detector comprises an envelope estimator unit comprising an ABS unit for providing a magnitude of the time-domain electric input signal y(n) or a signal derived therefrom at said first rate $F_{s1}$, a buffer unit of a buffer size D for buffering D samples of the magnitude of the time-domain electric input signal, a MAX unit for determining a maximum magnitude value among the D samples of the magnitude of the time-domain electric input signal presently stored in said buffer unit, wherein a maximum value is provided at a second rate $F_{s2}$ lower than said first rate $F_{s1}$.

4. A hearing device according to claim 1 wherein said onset detector comprises a differentiator for determining said first order derivative of the envelope of said time-domain at electric input signal or a signal derived therefrom and to provide the onset control signal dependent thereon.

5. A hearing device according to claim 1 configured to modify said onset control signal according to a predefined criterion to be equal to a constant value, when the current value of said first order derivative is below an onset threshold value, and to be equal to the current value of said first order derivative, when it is above an onset threshold value.

6. A hearing device according to claim 1 wherein the level estimation unit comprises a pre-smoothing unit for reducing large variance in the said frequency sub-band signals, or signals derived therefrom, and to provide pre-smoothed levels of said frequency sub-band signals.

7. A hearing device according to claim 6 wherein the level adjustment unit is configured to base the level adjustment on a level-change, which is given by the onset detector and the pre-smoothed level observed at the output of the pre-smoothing unit.

8. A hearing device according to claim 6 configured to keep a level estimate after a pre-smoother at a fixed level for a first time period, when an onset detected by the onset detector exceeds a certain threshold, wherein the fixed level value is determined in dependence of a level-increase which is given by the onset detector and an actual level observed at an output of the pre-smoother.

9. A hearing device according to claim 8 wherein the first time period is dependent on a delay of the analysis filter bank.

10. A hearing device according to claim 8 configured to provide that a level estimate returns to the pre-smoother level when the first time period has lapsed or when the level at the pre-smoother output exceeds the adjusted level.

11. A hearing device according to claim 1 comprising a final smoothing unit for smoothing the adjusted levels from the adjustment unit.

12. A hearing device according to claim 11 wherein the final smoothing unit is configurable in that it provides dynamically determined attack and release time-constants, which are applied in the determination of final level estimates of said frequency sub-band signals, or signals derived therefrom.

13. A hearing device according to claim 1 wherein the level adjustment unit is configured to maintain an adjusted level estimate at a certain level for a predefined time.

14. A hearing device according to claim 1 wherein the level adjustment unit comprises a counter and is configured to maintain an adjusted level estimate for a number of time frames smaller than a threshold number.

15. A hearing device according to claim 1 wherein the signal processing unit is configured to receive said current level of said frequency sub-band signals Y(k,m) or frequency sub-band signals derived therefrom from said level estimation unit and to control said one or more processing algorithms in dependence thereof.

16. A hearing device according to claim 1 comprising a hearing instrument, a headset, an ear protection device or a combination thereof.

17. A method of operating a hearing device, the method comprising providing a time-domain electric input signal y(n) representing a sound signal in a full-band frequency range forming part of the audible human frequency range, n being a time-sample index;

converting said electric input signal y(n) to a time-frequency representation Y(k,m), where k=1, 2, . . . , K is a frequency sub-band index, K being the number of frequency sub-bands, and each frequency sub-band representing a frequency sub-band $FB_k$ of the full-band frequency range, and m is a time frame index;

executing one or more processing algorithms for processing a signal of the forward path in a number of processing channels, each comprising one or more of said frequency sub-bands, and providing a number of processed channel-signals;

wherein the method further comprises determining a current first order derivative of said time-domain electric input signal y(n), or a signal derived therefrom before said conversion to the time-frequency representation Y(k,m), and providing an onset control signal;

estimating a current level of said frequency sub-band signals Y(k,m) or frequency sub-band signals derived therefrom, adjusting current levels of said frequency sub-band signals, or signals derived therefrom, and controlling said level adjustment in dependence of said onset control signal.

18. A non-transitory computer readable medium having stored thereon a computer program comprising instructions which, when executed by a computer, causes the computer to carry out the method of claim 17.

19. A data processing system comprising:

a memory storing program code means for operating a hearing device; and a processor configured to provide a time-domain electric input signal y(n) representing a sound signal in a full-band frequency range forming part of the audible human frequency range, n being a time-sample index;

convert said electric input signal y(n) to a time-frequency representation Y(k,m), where k=1, 2, . . . , K is a frequency sub-band index, K being the number of frequency sub-bands, and each frequency sub-band representing a frequency sub-band $FB_k$ of the full-band frequency range, and m is a time frame index;

execute one or more processing algorithms for processing a signal of the forward path in a number of processing channels, each comprising one or more of said frequency sub-bands, and providing a number of processed channel-signals;

wherein the processor is further configured to determine a current first order derivative of said time-domain electric input signal y(n), or a signal derived therefrom before said conversion to the time-frequency representation Y(k,m), and providing an onset control signal;

estimate a current level of said frequency sub-band signals Y(k,m) or frequency sub-band signals derived therefrom, adjust the current levels of said frequency sub-band signals, or signals derived therefrom, and control said level adjustment in dependence of said onset control signal.

* * * * *